US006345809B1

(12) United States Patent
Bebendorf

(10) Patent No.: US 6,345,809 B1
(45) Date of Patent: Feb. 12, 2002

(54) FENCE PANEL

(76) Inventor: Ronald William Bebendorf, R.W. Bebendorf, 63 Michelangelo Cr., Mackenzie Qld 4156 (AU)

( * ) Notice: Subject to any disclaimer, the term of this patent is extended or adjusted under 35 U.S.C. 154(b) by 0 days.

(21) Appl. No.: 09/565,006

(22) Filed: May 4, 2000

(30) Foreign Application Priority Data

May 11, 1999 (AU) ..... 28087

(51) Int. Cl.[7] ..... E04K 17/14
(52) U.S. Cl. ..... 256/24; 256/31; 256/65
(58) Field of Search ..... 256/24, 19, 59, 256/65, 21, 22, 31–DIG. 5, 25, 35, 64; 52/298, 165

(56) References Cited

U.S. PATENT DOCUMENTS

| | | | | | |
|---|---|---|---|---|---|
| 1,378,948 | A | * | 5/1921 | Hage | 52/298 |
| 3,037,593 | A | | 6/1962 | Webster | 189/34 |
| 3,652,060 | A | | 3/1972 | Glover | |
| 3,822,053 | A | * | 7/1974 | Daily | 256/22 |
| 3,963,219 | A | | 6/1976 | D'Amico | |
| 4,133,154 | A | * | 1/1979 | Ruzicka | 52/298 |
| 4,148,277 | A | * | 4/1979 | Engle et al. | 256/21 X |
| 4,188,019 | A | * | 2/1980 | Meredith | 256/24 |
| 4,198,034 | A | * | 4/1980 | Svirklys | 256/65 |
| 5,100,107 | A | | 3/1992 | Latta | 256/19 |
| 5,255,897 | A | * | 10/1993 | Pepper | 256/24 |
| 5,628,495 | A | | 5/1997 | Gandara | 256/24 |
| 5,639,069 | A | | 6/1997 | McClure | 256/25 |
| 5,702,090 | A | | 12/1997 | Edgman | 256/19 |
| 5,848,502 | A | * | 12/1998 | Schaefer | 52/165 |
| 5,988,599 | A | | 11/1999 | Forbis | 256/24 |
| 6,039,307 | A | * | 3/2000 | De Zen | 256/19 |
| 6,041,486 | A | | 3/2000 | Forbis | 29/453 |

* cited by examiner

*Primary Examiner*—Harry C. Kim
(74) *Attorney, Agent, or Firm*—Rudolf O. Siegesmund

(57) ABSTRACT

A fence panel comprising of sections which can be simply attached together without the need for any separate fasteners, concrete and the like.

6 Claims, 4 Drawing Sheets

FENCE PANEL

BACKGROUND OF THE INVENTION

This application claims foreign priority benefits from Australian application AU199928087 B1 filed May 11, 1999.

1. Field of the Invention

The present invention relates to a fence panel comprising of sections which can be simply attached together without the need for any separate fasteners, concrete and the like. The fence panels provide complete privacy but do not restrict prevailing breezes. The fence panels are particularly suited for domestic applications but need not be limited to such.

2. Description of the Prior Art

The majority of house holders and professional fencing contractors are aware of the difficulties and time consuming process of constructing fences. A product that is quick and easy to construct and is relatively inexpensive would be desirable to such people.

Fences are usually used in an urban environment around the perimeter of a property, as dividers between the front and back yards and as swimming pool fencing. Gates are typically installed in the front of the property.

A very popular fence type is a paling fence. The material typically used for this type of fence is either a fencing grade rough sawn hardwood or treated pine. If a presentable and an easily painted finish is required it is desirable to arris all edges of these timbers. A number of specialized tools are necessary to achieve this result. Even with these tools this exercise is a time consuming and laborious job.

Generally fences are painted to improve both aesthetics and durability of the timbers. Usually a minimum of two coats of acrylic paint or an oil based stain is required to provide an acceptable finish. A third coat can be applied for a better finish and protection. Repainting is generally required every six or seven years. Painting again is a laborious and expensive process. If a trades person is instructed to paint the fence, the cost of painting often exceeds the cost of the fence.

A problem with using timber for fencing is its lack of durability and stability. Over a short period of time it may warp and split with resultant poor aesthetics. Timber is also susceptible to wet rot and termite damage. Also timber, particularly hardwood is becoming scarce and a socially unacceptable commodity.

SUMMARY OF THE INVENTION

It is the object of the present invention to provide a pre-finished fencing assembly which will overcome the above mentioned disadvantages and provide a useful or commercial choice. The present invention can also be dismantled in the reverse manner of assembly to enable ease of repainting or access of machinery for the purpose of landscaping, swimming pool building and the like.

The fence assembly comprising a plurality of post members, a plurality of rail members and a plurality of paling members, said post members connected to said rail members and said rail members connected to said paling members. The connection established between said post and rail members is through openings on the inside face of the said post and projections at the end of said rail. The connection between the said paling members is established by passing the said paling members through a plurality of openings in the said rail members.

The post members and rail members when connected may be perpendicular with respect to one another. Also the rail members and paling members, when connected, may be perpendicular with respect to one another.

The post members may be used to locate the rail members. Typically the post member is formed from a rectangle hollow section and the rectangle hollow section may be formed from a sheet or plate of metal which has been configured to the rectangular hollow section and may be hollow and elongate.

The post members may have a number of openings on the inside face. Typically there are three sets of two openings. The three sets of two openings may be parallel. There may be two openings for every set of openings. An opening is typically rectangular in shape.

The bottom of the post member may be connected to a foot. Typically the foot is a pre-cast concrete block. The block may have a cavity extending downwardly from the top wall to a depth suitable to hold the fence post. The cavity may be enlarged at one side to accept a holding wedge.

These wedges may be formed from a composite material. The wedge will be typically rectangular when viewed in plane. It may be elongated, tapering and solid.

The wedge will both secure the post at the required height and enable the post to be removable.

The rail members may also comprise rectangular hollow sections and these may also be formed from a metal sheet or plate which is configured to adopt a rectangular hollow section shape.

The rail members may have a plurality of openings. The openings may extend along the length of the rail member. The openings may be in alignment and parallel with one another. The openings are typically located on the top edge of the bottom rail, on the bottom edge of the top rail and through the top and bottom edges of the center rail. They may be rectangular in shape.

At the ends and at the sides of the rail members may be projections. These projections may be able to mate with the openings on the posts.

The paling members may comprise of a pressed hardwood fiber board which is configured to adopt a rectangular shape when viewed in plane. They may be elongate. They may be adapted to pass through the rail members.

The foregoing and other objects, features and advantages of the invention will be apparent from the following more particular description of a preferred embodiment of the invention, as illustrated in the accompanying drawings wherein like reference numbers represent like parts of the invention.

BRIEF DESCRIPTION OF THE DRAWINGS

An embodiment of the invention will be illustrated with reference to the accompanying drawings in which.

DESCRIPTION OF THE PREFERRED EMBODIMENTS

Figure 1:
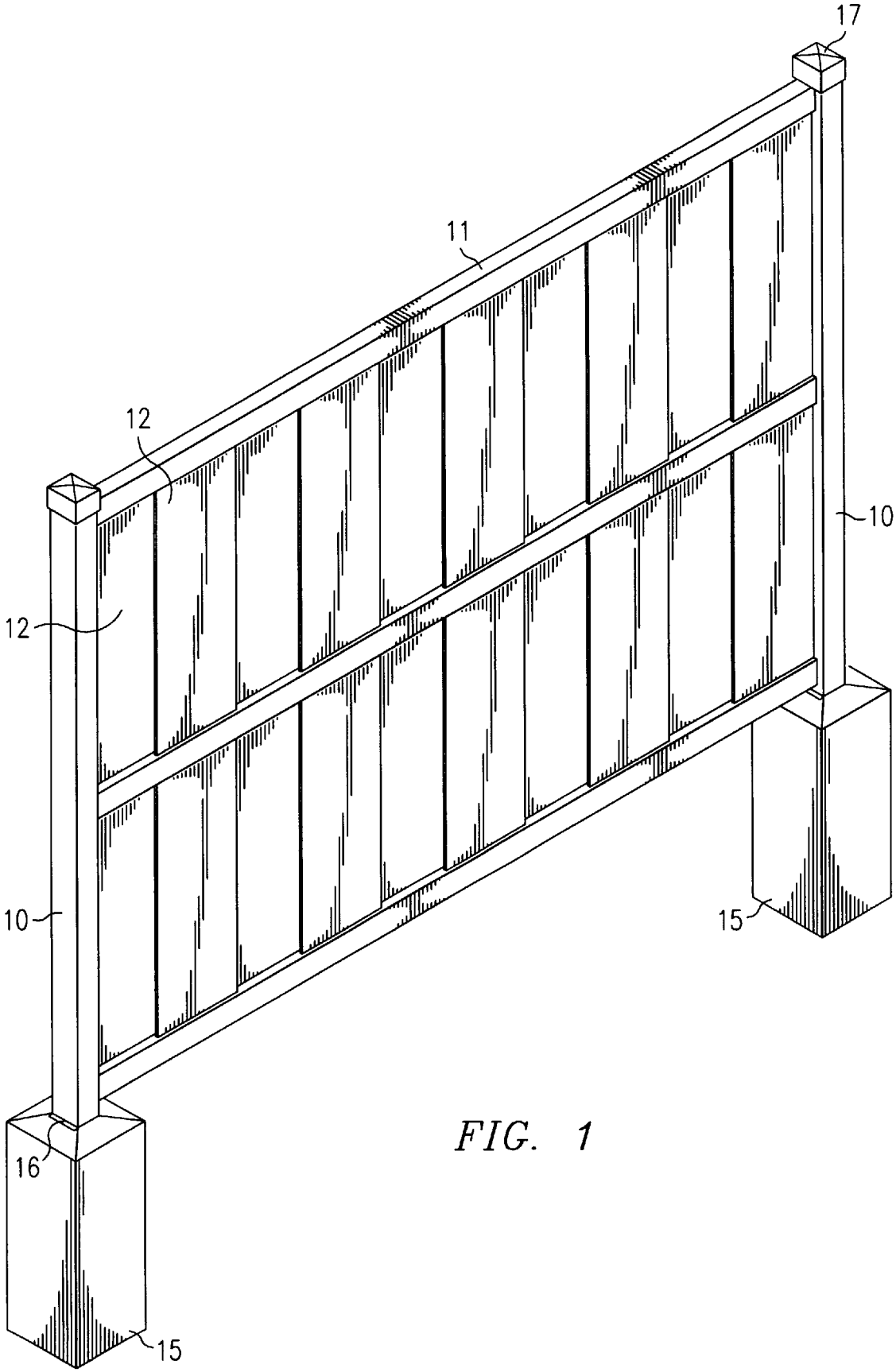
FIG. 1 illustrates a perspective view of a fence panel assembly according to an embodiment of the invention.

Referring to FIG. 1 there is shown a fence assembly comprising a foot 15, a wedge 16, a post member 10, a rail member 11, a paling member 12 and a capping member 17.

Figure 5:
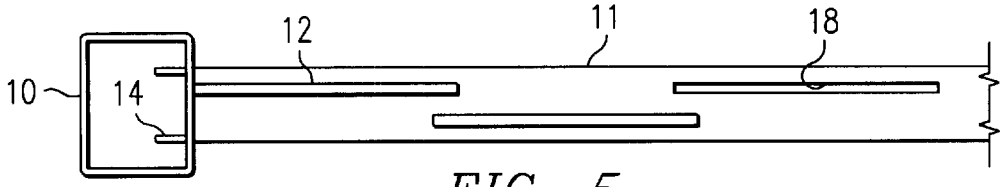
FIG. 5 illustrates a fragmented enlargement of a fence rail member attached to a post according to FIG. 3.
Figure 10:
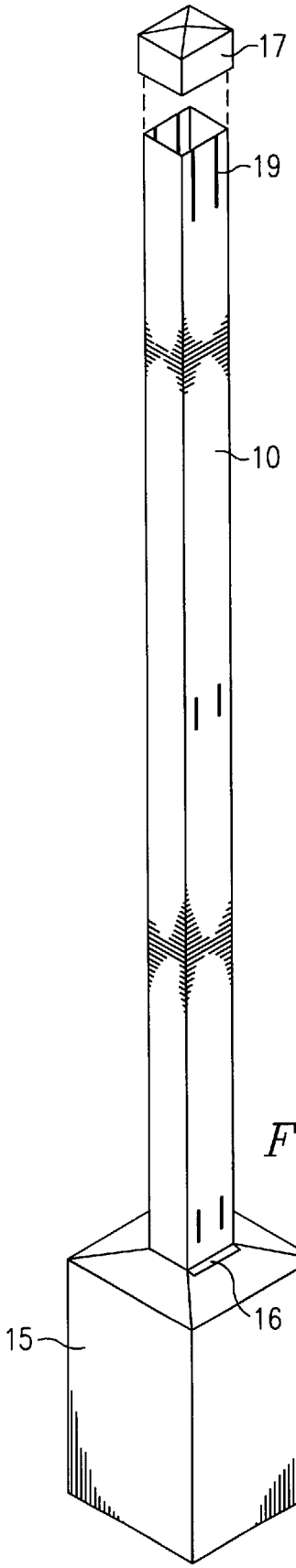
FIG. 10 illustrates a view of a post, post cap, post wedge and post foot according to FIG. 1.

Referring to FIGS. 5 and 10, it can be seen that the post member 10 is formed from a rectangular hollow section. It is hollow and elongate. The post member 10 has three thin sets of two openings 19 located on its inner wall. The openings 19 are rectangular in shape, the two top openings extend to the top of the post. Above post member 10 is a capping 17 that is rectangular in shape at the top with four sides. The top is raised at the center.

Figure 3:
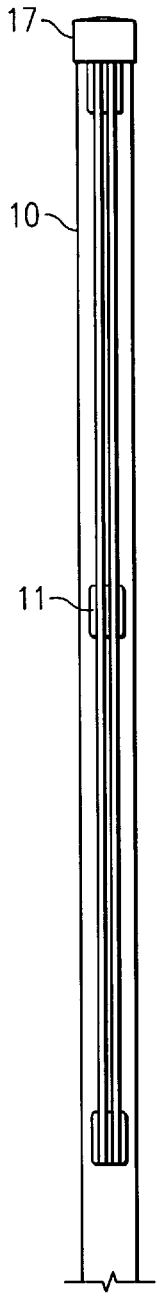
FIG. 3 illustrates a sectional view of a fence panel according to FIG. 4.
Figure 4:
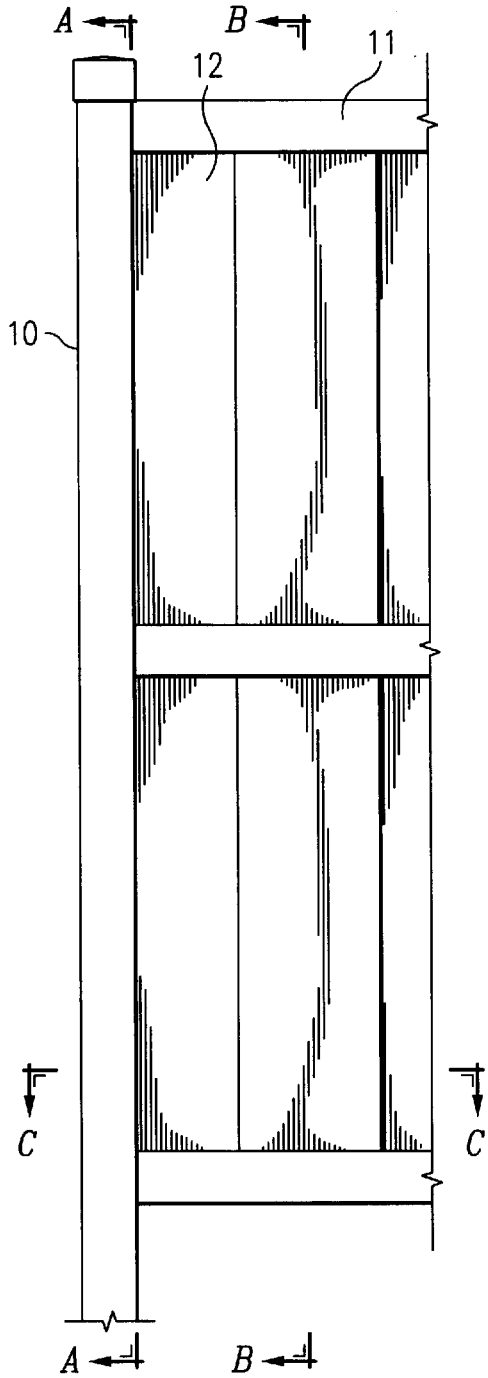
FIG. 4 illustrates a partial front section of a fence panel according to FIG. 1.
Figure 8:
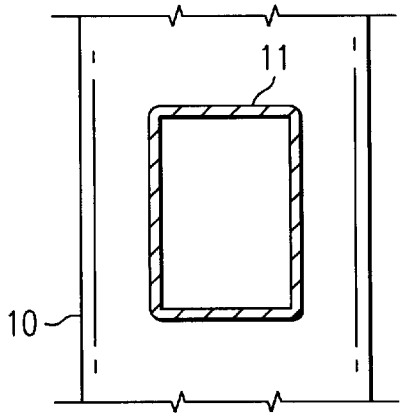
FIG. 8 illustrates a fragmented view of a post and rail member.
Figure 12:
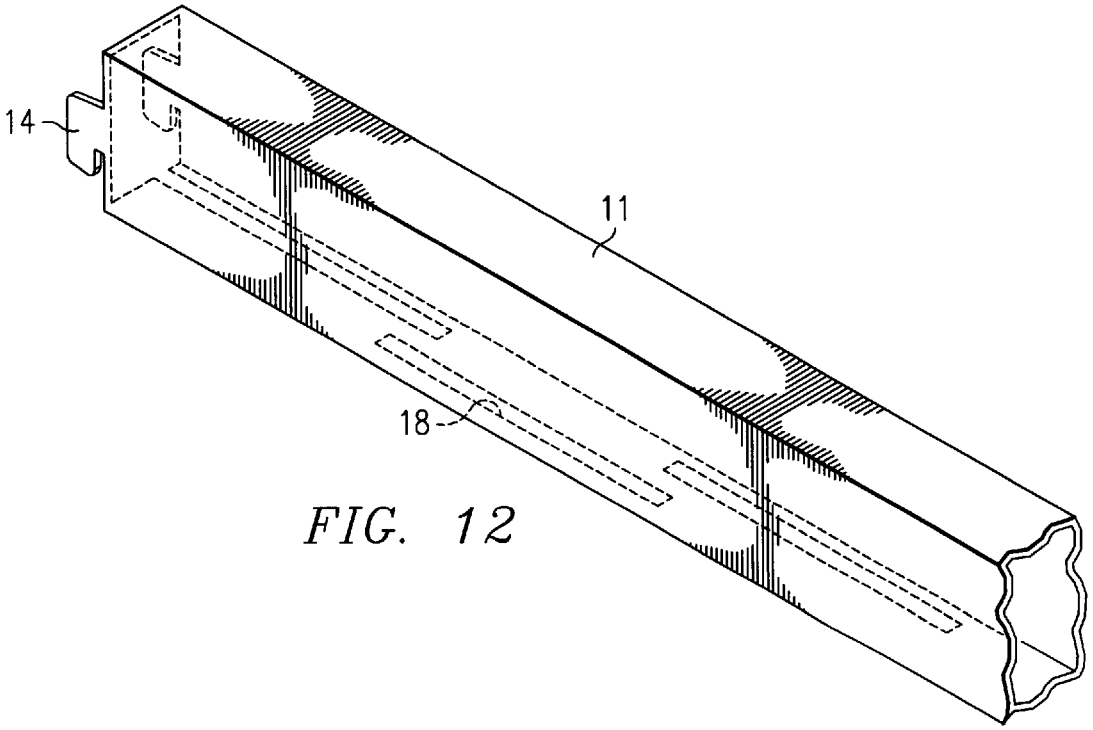
FIG. 12 illustrates a view of a top rail.

Referring to FIGS. 3 and 8 it can be seen that the rail member 11 is formed from a rectangular hollow section. The rail member 11 has openings 18 located along the length of the rail member 11. The openings 18 are rectangular in shape. They are equally spaced along the length of the edge of rail member 11. They are aligned with and run parallel with one another. Openings at either side overlap one another on member 11. The center rail has these openings on both edges which align with one another. Extending along at the ends of the side walls of member 11 is a hooked shape projection 14.

Referring to FIGS. 1 and 5 it can be seen that the paling member 12 is rectangular in shape when viewed in plane. The paling member 12 is elongate and solid.

Figure 9A:
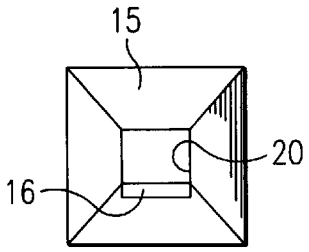
FIG. 9 illustrates a top/side view of a post foot.
Figure 9B:
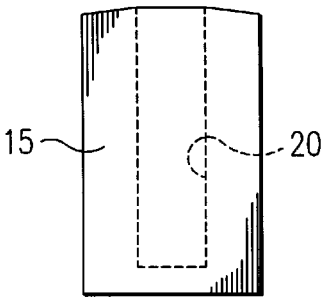
Figure 11:
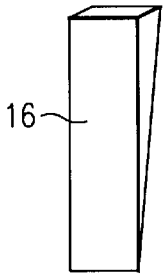
FIG. 11 illustrates a perspective view of a foot wedge.

Referring to FIGS. 9 and 10 it can be seen that the foot is a rectangular block. Extending from the top wall downwardly is a cavity 20. The cavity 20 increased in size part way down one side. The cavity 20 is able to locate the post member 10. The wedge 16 is used to secure the post member 10 to the cement block at the required height.

Figure 7:
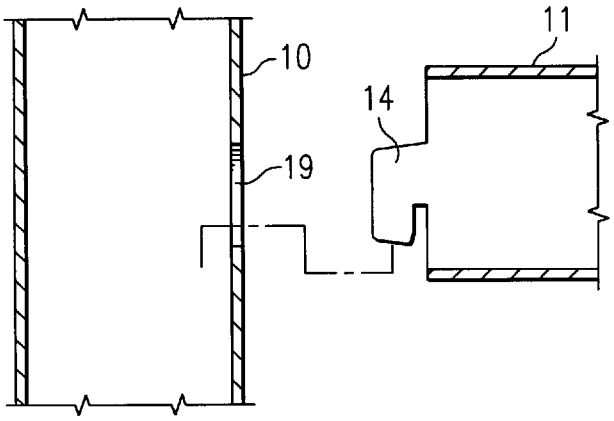
FIG. 7 illustrates a technique used to couple the center and bottom rail member to a post according to FIG. 3.

Referring to FIG. 7 it is shown how the post members 10 and center and bottom rail members 11 are coupled.

Referring to FIGS. 1 and 5 it can be seen how paling member 12 can be inserted through the center and bottom rail members 11.

Figure 2:
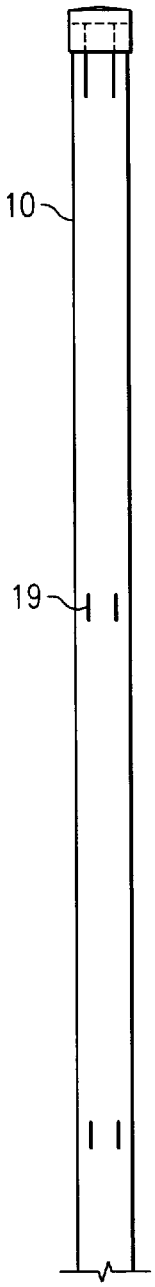
FIG. 2 illustrates the inside face of a post member according to FIG. 10.
Figure 6:
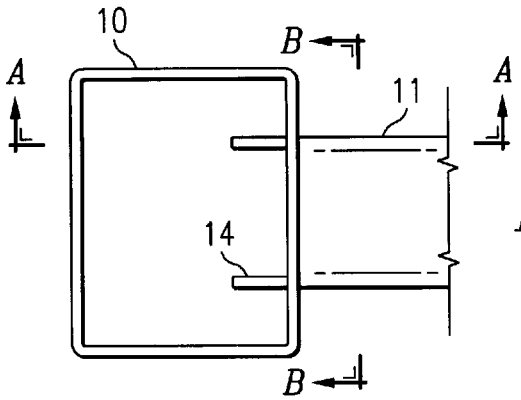
FIG. 6 illustrates a top view of a top rail member attached to a post according to FIG. 3.

Referring to FIGS. 2 and 6 it is shown how top rail member 11 is inserted from the top of the post to secure batten members 12 and to also lock into post member 10.

It should be appreciated that various other minor changes and modifications may be made to the embodiment described without departing from the spirit and scope of the invention as claimed.

What is claimed:

1. A fence assembly comprising:

a plurality of post members, a plurality of post feet, a plurality of post wedges, a plurality of rail members, a plurality of post cappings and a plurality of paling members;

wherein said post members locate in said post feet and are secured with said post wedges;

wherein said post members connect to said rail members by interlocking insertion of a plurality of rail member hooks with a plurality of post member rectangular openings and said paling members connect to said rail members by insertion in a plurality of parallel and overlapping rail member rectangular openings;

wherein said rail member hooks extend from each end of said rail member and are of unitary construction with said rail member.

2. The fence assembly of claim 1 wherein the post members locate in said post feet and are secured with said wedges to enable the fence to remain in a stationery position, said post cappings connect to the top of said post members.

3. The fence assembly of claim 1 wherein the post members and the rail members when connected are substantially perpendicular with respect to one another.

4. The fence assembly of claim 1 wherein the rail members and the paling members, when connected, are substantially perpendicular with respect to one another.

5. The fence assembly of claim 1, wherein the post members are formed from a rectangular hollow section formed from a sheet of metal, the paling members are formed from a pressed hardwood fibre board, the post feet are formed from concrete and the post wedges are formed from a composite material.

6. A method of constructing a fence assembly comprising:

inserting a plurality of post members into a plurality of post feet;

locking a plurality of mid rails and a plurality of bottom rails into the plurality of post members by inserting a plurality of mid rail hooks into a plurality of post member mid slots and by inserting a plurality of bottom rail hooks into a plurality of post member bottom slots, wherein each of the plurality of mid rails have openings on a mid rail top edge and a mid rail bottom edge and each of the plurality of bottom rails have openings on bottom rail top edge only;

locating the plurality of post members in said plurality of post feet;

securing said plurality of post members in said plurality of post feet with a plurality of post wedges;

dropping a plurality of paling members through said mid rails and said bottom rails;

locking a plurality of top rails into a plurality of post member openings wherein each of the plurality of top rails have a plurality of top rail openings only on a top rail bottom edge;

aligning the plurality of top rail openings with the plurality of paling members with said rail openings;

locking each of said top rails down into a bottom of a plurality of post member top slots; and inserting a plurality of post caps over a plurality of post member tops.

* * * * *